US010836600B2

(12) United States Patent
Tanaka

(10) Patent No.: US 10,836,600 B2
(45) Date of Patent: Nov. 17, 2020

(54) IMAGE FORMING APPARATUS

(71) Applicant: KYOCERA Document Solutions Inc., Osaka (JP)

(72) Inventor: Koichi Tanaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 228 days.

(21) Appl. No.: 16/222,625

(22) Filed: Dec. 17, 2018

(65) Prior Publication Data

US 2019/0185287 A1 Jun. 20, 2019

(30) Foreign Application Priority Data

Dec. 20, 2017 (JP) ..... 2017-243700

(51) Int. Cl.

| | |
|---|---|
| ***G03G 15/23*** | (2006.01) |
| ***B65H 43/08*** | (2006.01) |
| ***G03G 15/00*** | (2006.01) |
| ***B65H 29/60*** | (2006.01) |
| ***B65H 85/00*** | (2006.01) |
| ***B65H 15/00*** | (2006.01) |

(52) U.S. Cl.

CPC ..... *B65H 43/08* (2013.01); *B65H 15/00* (2013.01); *B65H 29/60* (2013.01); *B65H 85/00* (2013.01); *G03G 15/234* (2013.01); *G03G 15/5016* (2013.01); *G03G 15/5062* (2013.01); *G03G 15/6508* (2013.01); *G03G 15/6511* (2013.01); *B65H 2301/33312* (2013.01); *B65H 2801/06* (2013.01)

(58) Field of Classification Search

CPC ..... G03G 15/234

USPC ..... 399/389

See application file for complete search history.

(56) References Cited

U.S. PATENT DOCUMENTS

| | | | | |
|---|---|---|---|---|
| 6,345,170 | B1 * | 2/2002 | Nakazato | G03G 15/6564 399/21 |
| 6,470,169 | B2 * | 10/2002 | Nakazato | G03G 15/234 399/388 |
| 2002/0051665 | A1 * | 5/2002 | Seto | G03G 15/234 399/388 |
| 2007/0071524 | A1 * | 3/2007 | Nakamura | G03G 15/234 399/341 |
| 2011/0128596 | A1 * | 6/2011 | Tonooka | H04N 1/00591 358/498 |

FOREIGN PATENT DOCUMENTS

JP 2003-316206 A 11/2003

* cited by examiner

*Primary Examiner* — Anthony H Nguyen
(74) *Attorney, Agent, or Firm* — Stein IP, LLC

(57) ABSTRACT

The image forming apparatus includes: a printing section for conveying a sheet of paper; a reversal section for reversing top-and-back orientation of a sheet; and a control section for, based on an output of an image detection sensor resulting when a sheet has passed through a detection position for the first time, detecting whether or not a first surface is a blank surface, and moreover, based on an output of the image detection sensor resulting when the sheet subjected to reversal process has once again passed through the detection position, detecting whether or not a second surface is a blank surface, whereby the control section decides whether a sheet feed cassette is a back-sided sheet-containing cassette or a new sheet-containing cassette.

12 Claims, 6 Drawing Sheets

IMAGE FORMING APPARATUS

INCORPORATION BY REFERENCE

This application is based upon and claims the benefit of priority from the corresponding Japanese Patent Application No. 2017-243700 filed on Dec. 20, 2017, the entire contents of which are incorporated herein by reference.

BACKGROUND

The present disclosure relates to an image forming apparatus for printing images on paper sheets.

Conventionally, there is known an image forming apparatus including an image detection means which detects whether or not there is an image on a sheet of paper for use in printing (i.e., a paper sheet prior to printing).

The conventional image forming apparatus conveys a sheet along a sheet conveyance path running via a printing position. When the sheet under conveyance passes through the printing position, the image forming apparatus prints an image on the sheet. Meanwhile, the image detection means is installed at a position which is sheet-conveyance upstream of the printing position on the sheet conveyance path. The image detection means is a transmission optical sensor including a light-emitting part and a light-receiving part.

In the conventional system, image detection for a sheet passing through a detection position of the image detection means is executed during execution of double-sided printing. When presence of an image on the sheet is detected, double-sided printing using this sheet is prohibited.

SUMMARY

An image forming apparatus according to the present disclosure includes: a sheet feed cassette, a printing section, a reversal section, an image detection sensor, and a control section. The sheet feed cassette serves for containing sheets of paper therein. The printing section includes a main conveyance path running through a sheet feed position, a detection position, and a printing position in this order, and serves for feeding a sheet out of the sheets contained in the sheet feed cassette from the sheet feed position to the main conveyance path, then conveying the sheet along the main conveyance path, and printing an image on one surface out of two surfaces of the sheet passing through the printing position, the one surface facing toward one side of the main conveyance path. The reversal section reverses top-and-back orientation of a sheet by pulling in the sheet at a halfway position between the detection position and the printing position of the main conveyance path, switching back the pulled-in sheet, and executing a reversal process of returning the switched-back sheet from the halfway position between the sheet feed position and the detection position of the main conveyance path to the main conveyance path. The control section serves for detecting an image on a sheet passing through the detection position. The control section, in execution of a print job involving printing by the printing section, executes a first detection process of, based on an output of the image detection sensor resulting when a sheet fed to the main conveyance path has passed through the detection position for the first time, detecting whether or not a first surface of the sheet is a blank surface, and moreover executes a second detection process of, based on an output of the image detection sensor resulting when the sheet fed to the main conveyance path has once again passed through the detection position after the reversal process by the reversal section, detecting whether or not a second surface of the sheet opposite to the first surface is a blank surface, whereby the control section, based on individual results of the first detection process and the second detection process, executes a sheet decision process of deciding whether the sheet feed cassette is a back-sided sheet-containing cassette in which back-sided sheets with images present only on one surface are contained or a new sheet-containing cassette in which new sheets with images present on neither of their two surfaces are contained.

DETAILED DESCRIPTION

<Configuration of Image Forming Apparatus>

Figure 1:
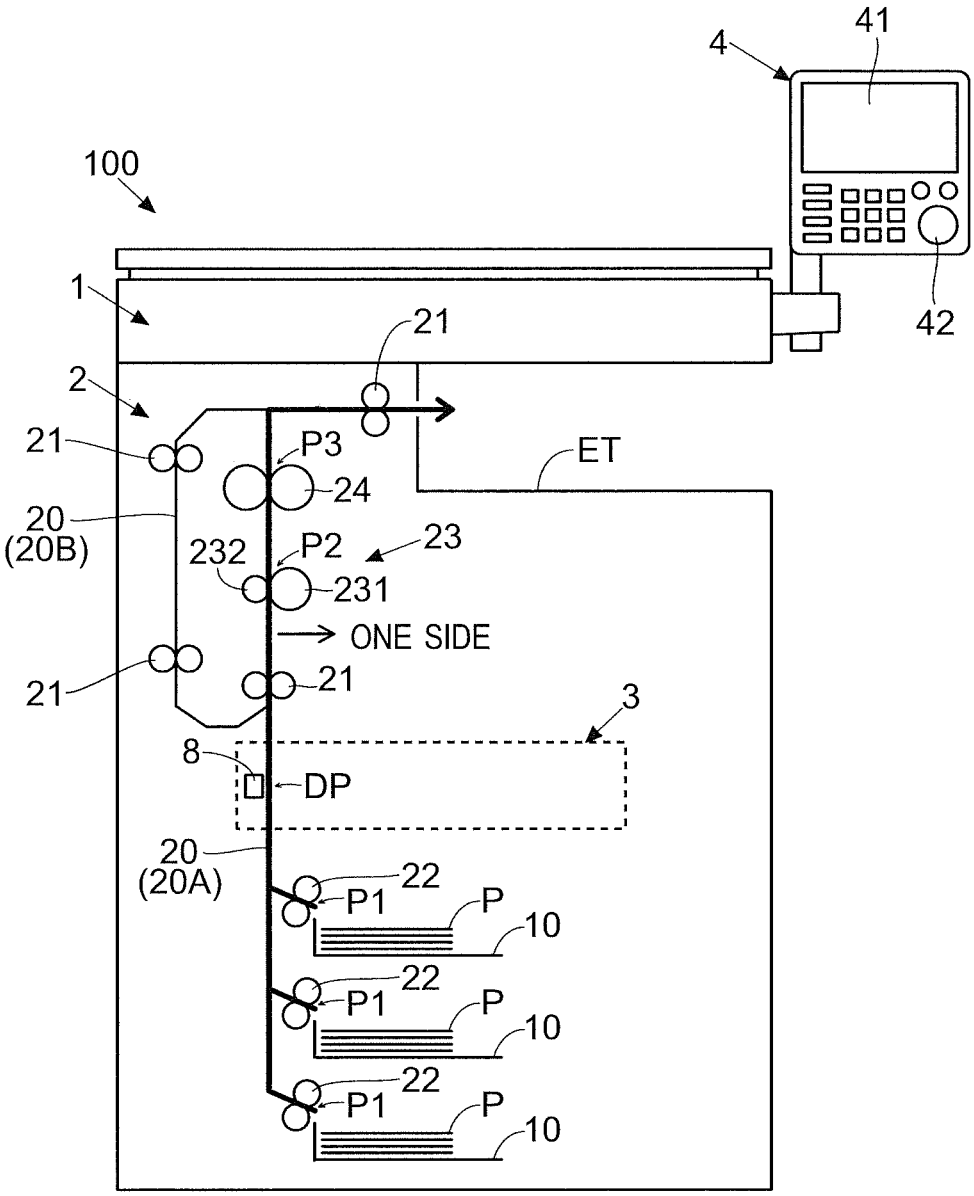
FIG. 1 is a schematic view showing an overall configuration of an image forming apparatus according to one embodiment of the disclosure.

As shown in FIG. 1, an image forming apparatus 100 of this embodiment includes an image reading section 1. The image reading section 1 includes an unshown reading unit for optically reading an original document. The reading unit includes a light source, an image sensor, and the like. The image reading section 1 reads the document to generate image data of the document.

The image forming apparatus 100 also includes a printing section 2. The printing section 2 is enabled to execute both one-sided printing and double-sided printing. During execution of a print job involving printing, the printing section 2, while conveying a sheet P, forms an image to be printed and prints the image on the sheet P under conveyance. For example, the printing section 2 executes printing based on image data of the document that the image reading section 1 has read. Paper sheets P to be used for a print job are contained in a sheet feed cassette 10.

The printing section 2, including a sheet conveyance path 20, is equipped with a plurality of conveyance roller pairs 21 for conveyance of a sheet P along the sheet conveyance path 20. The printing section 2 is further equipped with a sheet feed roller pair 22, an image forming part 23, and a fixing roller pair 24.

The sheet conveyance path 20 includes a main conveyance path 20A and a double-sided printing conveyance path 20B. In FIG. 1, the main conveyance path 20A is drawn by thick line so as to be distinguished from the double-sided printing conveyance path 20B. The main conveyance path 20A runs through a sheet feed position P1, a detection position DP, a printing position P2, and a fixing position P3, in this order. The double-sided printing conveyance path 20B branches from the main conveyance path 20A at a position which is sheet-conveyance downstream of the fixing position P3 of the main conveyance path 20A. The double-sided printing conveyance path 20B then merges with the main conveyance path 20A at a position which is sheet-conveyance upstream of the printing position P2 (sheet-conveyance downstream of the detection position DP) of the main conveyance path 20A.

The sheet feed roller pair 22 is placed at the sheet feed position P1. The sheet feed roller pair 22 feeds a sheet P contained in a sheet feed cassette 10 from the sheet feed position P1 to the main conveyance path 20A. For example, a pickup roller (not shown) is placed above the sheet feed cassette 10. A sheet P is pulled out from the sheet feed cassette 10 by the pickup roller before the sheet P is fed to the main conveyance path 20A by the sheet feed roller pair 22.

The sheet feed cassette 10 is made settable to and removable from the image forming apparatus 100. When a user performs work of setting paper sheets P in the sheet feed cassette 10 (the work including process of reversing the sheets P in their top-and-back orientation), the sheet feed cassette 10 is pulled out from the image forming apparatus 100. Upon completion of the work by the user, the sheet feed cassette 10 is set up again to the image forming apparatus 100.

As an example, a plurality of sheet feed cassettes 10 are set up to the image forming apparatus 100. In the case where a plurality of sheet feed cassettes 10 are set up to the image forming apparatus 100, it is possible that sheets P having some image on one surface and no image on the other surface (hereinafter, referred to as back-sided sheets P when appropriate) are contained in one sheet feed cassette 10 while brand-new sheets P having images on neither of its two surfaces (hereinafter, referred to as new sheets P when appropriate) are contained in another sheet feed cassette 10. In the case where a plurality of sheet feed cassettes 10 are set up to the image forming apparatus 100, one sheet feed roller pair 22 is assigned to each one of the plural sheet feed cassettes 10 (plural sheet feed positions P1 are provided). FIG. 1 shows a case, as an example, in which three sheet feed cassettes 10 are set up to the image forming apparatus 100.

When a sheet P contained in a sheet feed cassette 10 is fed from the sheet feed position P1 to the main conveyance path 20A, the fed sheet P is conveyed along the main conveyance path 20A. The sheet P first passes through the detection position DP, thereafter passing through the printing position P2 and the fixing position P3 in this order. The sheet P over printing is finally discharged onto a discharge tray ET.

The image forming part 23 includes a photosensitive drum 231 and a transfer roller 232. The image forming part 23 further includes a charging device for electrically charging a circumferential surface of the photosensitive drum 231, an exposure device for forming an electrostatic latent image on the circumferential surface of the photosensitive drum 231, a developing device for developing an electrostatic latent image on the circumferential surface of the photosensitive drum 231 into a toner image, and the like, these members being unshown in the figure. The photosensitive drum 231 and the transfer roller 232 are in pressure contact with each other to form a transfer nip (a position of the transfer nip serves as the printing position P2). When the sheet P passes through the printing position P2, the image forming part 23 transfers onto the sheet P a toner image on the circumferential surface of the photosensitive drum 231.

The image forming part 23 prints an image on one surface out of two surfaces of a sheet P passing through the printing position P2, the one surface facing toward one side of the main conveyance path 20A (in FIG. 1, toward the right side as viewed from the front of the image forming apparatus 100). In this case, for printing of an image on the other surface of the sheet P that has faced toward the other side of the main conveyance path 20A opposite to its one side (in FIG. 1, toward the left side as viewed from the front of the image forming apparatus 100), it is necessary to reverse the top-and-back orientation of the sheet P after the sheet P has passed through the printing position P2 and the fixing position P3.

The fixing roller pair 24 includes a heating roller and a pressure roller. The heating roller has a built-in heater. The pressure roller is set in pressure contact with the heating roller to form a fixing nip against the heating roller (a position of the fixing nip serves as the fixing position P3). The fixing roller pair 24 heats and pressurizes the sheet P passing through the fixing position P3 (i.e., the sheet P fed up from the printing position P2) to fix the toner image on the sheet P.

In execution of a one-sided print job, when a one-sided printing sheet P, which is a sheet P having an image printed on one surface, has passed through the printing position P2 and the fixing position P3, the printing section 2 conveys the one-sided printing sheet P along the main conveyance path 20A as it is. Then, the printing section 2 discharges the one-sided printing sheet P onto the discharge tray ET.

In execution of a double-sided print job, when the one-sided printing sheet P has passed through the printing position P2 and the fixing position P3, the printing section 2 switches back the one-sided printing sheet P and pulls the switched-back sheet P into the double-sided printing conveyance path 20B. Thereafter, the printing section 2 conveys the one-sided printing sheet P along the double-sided printing conveyance path 20B so that the one-sided printing sheet P is returned to a position which is sheet-conveyance upstream of the printing position P2 on the main conveyance path 20A. Then, the printing section 2 conveys the one-sided printing sheet P to the printing position P2. When the one-sided printing sheet P returned to the main conveyance path 20A passes through the printing position P2, the one-sided printing sheet P has been reversed in its top-and-back orientation, so that an image is printed on an unprinted surface of the one-sided printing sheet P. The sheet P, having images printed on both surfaces, is conveyed along the main conveyance path 20A so as to be discharged onto the discharge tray ET.

Figure 2:
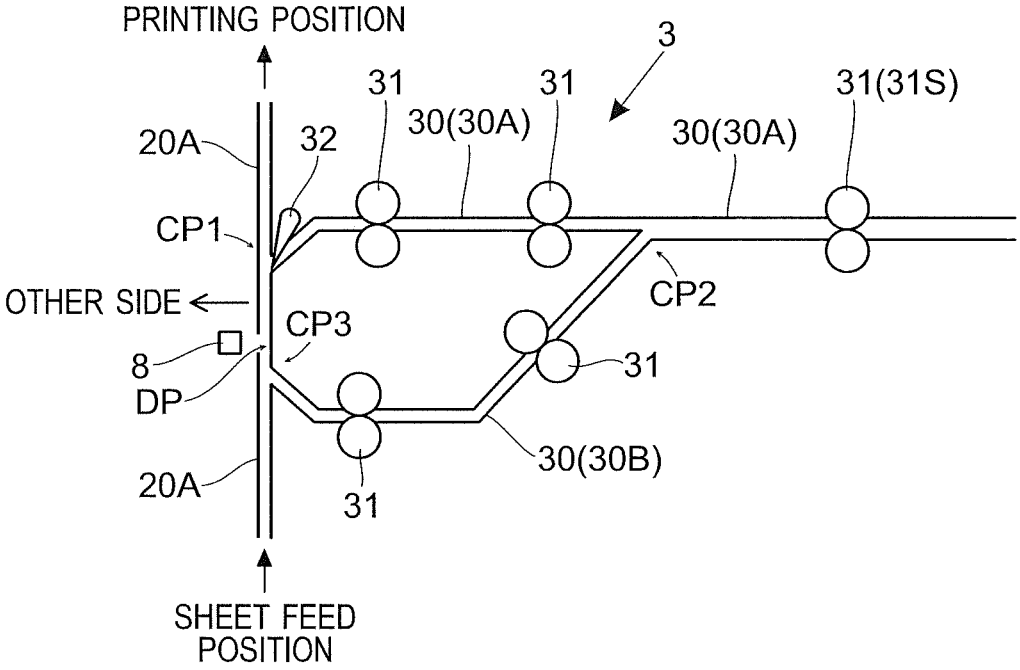
FIG. 2 is a schematic view showing a configuration of a reversal section in the image forming apparatus according to one embodiment of the disclosure.

The image forming apparatus 100 also includes a reversal section 3. The reversal section 3, as shown in FIG. 2, includes a reversal conveyance path 30 for conveying a sheet P. The reversal conveyance path 30 includes a first conveyance path 30A and a second conveyance path 30B. The reversal section 3 also includes a reversal conveyance roller pair 31 for conveying a sheet P along the reversal conveyance path 30. The reversal section 3 further includes a switching claw 32 for switching over the conveyance path of the sheet P.

One end of the first conveyance path 30A is connected to a position which is sheet-conveyance downstream of the detection position DP on the main conveyance path 20A (sheet-conveyance upstream of the printing position P2). One end of the second conveyance path 30B is connected to a position which is sheet-conveyance upstream of the detection position DP on the main conveyance path 20A (sheet-conveyance downstream of the sheet feed position P1), while the other end of the second conveyance path 30B is connected to a sheet-conveyance halfway position on the first conveyance path 30A. Hereinafter, a connecting position between the main conveyance path 20A and the first conveyance path 30A is denoted by reference sign CP1, a connecting position between the first conveyance path 30A and the second conveyance path 30B is denoted by reference sign CP2, and a connecting position between the second conveyance path 30B and the main conveyance path 20A is denoted by reference sign CP3.

In addition, in a case where a manual feed tray, which is not shown, is provided on a side face of the image forming apparatus 100, the other end of the first conveyance path 30A opposite to the above-mentioned one end may be connected to a sheet feed port of the manual feed tray. In this case, the reversal conveyance path 30 becomes usable as a conveyance path for manual sheet feed (a conveyance path for feeding a sheet P from the manual feed tray to the main conveyance path 20A).

The reversal conveyance roller pair 31 is provided in plurality on the reversal conveyance path 30. Number and position for the reversal conveyance roller pairs 31 to be provided may be changed as required depending on length or shape or the like of sheet conveyance paths of the reversal conveyance path 30.

The reversal conveyance roller pairs 31 provided on the first conveyance path 30A are rotated to feed a sheet P present on the first conveyance path 30A in such a direction that the sheet P goes away from the connecting position CP1. It is noted that out of the reversal conveyance roller pairs 31 provided on the first conveyance path 30A, one reversal conveyance roller pair 31 (hereinafter, denoted by reference sign 31S) provided on one side of the connecting position CP2 opposite to the connecting position CP1 side is made forward-and-reverse rotatable. Reversal conveyance roller pairs 31 provided on the second conveyance path 30B are rotated to feed a sheet P present on the second conveyance path 30B in such a direction that the sheet P goes on toward the connecting position CP3.

The switching claw 32 is provided pivotable at the connecting position CP1. The switching claw 32 is pivoted to switch over the conveyance path of the sheet P. While the switching claw 32 is in a normal position (in a state shown in FIG. 2), a conveyance path of the sheet P from the main conveyance path 20A to the first conveyance path 30A is closed. Then, making the switching claw 32 pivoted in that state allows the conveyance path of the sheet P from the main conveyance path 20A to the first conveyance path 30A to be opened.

Figure 3:
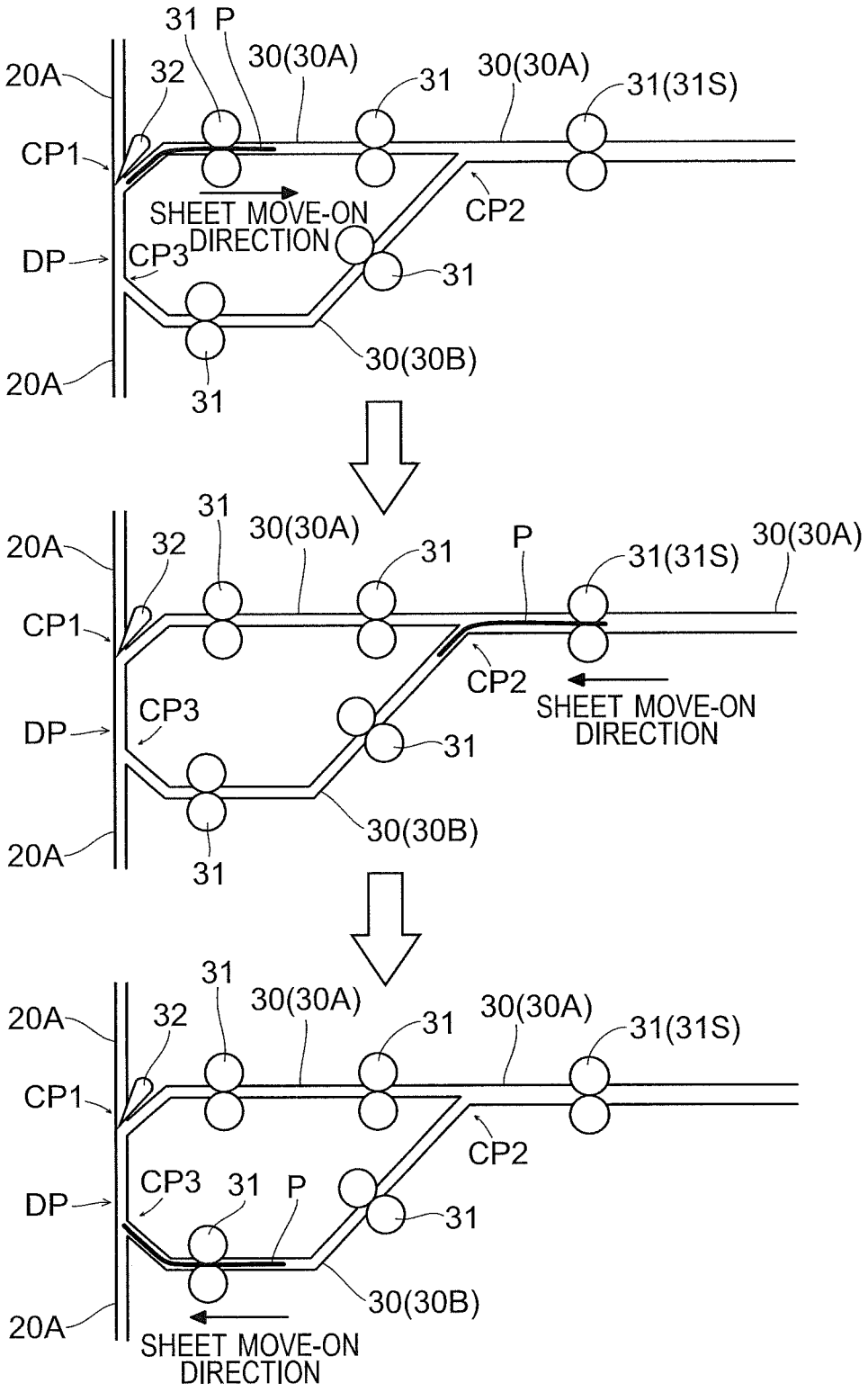
FIG. 3 is a view showing a flow of reversal process to be executed by the reversal section of the image forming apparatus according to one embodiment of the disclosure.

The reversal section 3 performs reversal process. The reversal process performed by the reversal section 3 allows an under-conveyance sheet P to be reversed in its top-and-back orientation on the sheet-conveyance upstream side of the printing position P2. The reversal process to be performed by the reversal section 3 will be detailed below with reference to FIG. 3.

For execution of the reversal process, the switching claw 32 is pivoted in such a direction as to open the conveyance path of the sheet P from the main conveyance path 20A to the first conveyance path 30A. As a result, the sheet P fed up from the sheet feed cassette 10 via the sheet feed position P1 and the detection position DP to the connecting position CP1 (or the sheet P fed up from the second conveyance path 30B via the connecting position CP3 and the detection position DP to the connecting position CP1) is pulled into the first conveyance path 30A (see the uppermost-stage view in FIG. 3).

In execution of the reversal process, the reversal conveyance roller pairs 31 (including the reversal conveyance roller pair 31S) on the first conveyance path 30A are rotated such that the sheet P goes away from the connecting position CP1. The reversal conveyance roller pairs 31 on the second conveyance path 30B are rotated so that the sheet P goes on toward the connecting position CP3.

At a time point when the sheet P is pulled into the first conveyance path 30A, the reversal conveyance roller pairs 31 on the first conveyance path 30A are being rotated, so that the sheet P pulled into the first conveyance path 30A is conveyed in such a direction as to go away from the connecting position CP1. Thereafter, when a rear end of the sheet P conveyed along the first conveyance path 30A has passed through the connecting position CP2, the reversal conveyance roller pair 31S is switched over in its rotational direction so as to switch back the sheet P (reverse the sheet P in its front-and-rear position). As a result, the switched-back sheet P is pulled from the first conveyance path 30A via the connecting position CP2 into the second conveyance path 30B (see the middle-stage view in FIG. 3).

Although not shown, a sheet detection part for detecting presence or absence of a sheet P (including its front-end arrival and rear-end passage), as an example, may be provided at the connecting position CP2 so as to allow the reversal conveyance roller pair 31S to be switched in its rotational direction when a specified time has elapsed since detection of the rear-end passage of the sheet P by the sheet detection part. Furthermore, a switching claw similar to the switching claw 32 may be provided at the connecting position CP2 so that the sheet P switched back on the first conveyance path 30A can be pulled from the connecting position CP2 into the second conveyance path 30B by pivoting the additional switching claw.

At the time point when the sheet P is pulled into the second conveyance path 30B, since the reversal conveyance roller pairs 31 on the second conveyance path 30B are being rotated, the sheet P pulled into the second conveyance path 30B is conveyed in such a direction as to go on toward the connecting position CP3. As a result, the sheet P pulled into the second conveyance path 30B is returned from the second conveyance path 30B via the connecting position CP3 to the main conveyance path 20A (see the lowermost-stage view in FIG. 3).

The sheet P returned from the reversal conveyance path 30 to the main conveyance path 20A passes once again through the detection position DP. In this case, the sheet P is reverse in its top-and-back orientation as compared to its last-time passage through the detection position DP. It is noted that the reversal process by the reversal section 3 is not necessarily executed at all times.

Reverting to FIG. 1, the image forming apparatus 100 includes an operation panel 4. The operation panel 4 corresponds to an 'notification part.' The operation panel 4 includes a touch panel display 41. The touch panel display 41 displays a setting screen with software buttons arranged therein, and accepts touch operations for the software buttons from a user. The operation panel 4 further includes a plurality of hardware buttons 42. An example of the hardware buttons 42 is a start button for accepting a print-job execution instruction from the user.

For execution of a print job, the operation panel 4 accepts print settings from the user. By the print settings, it can be set whether or not use of back-sided sheets is permitted. Also, the print settings make it possible to set whether one-sided printing or double-sided printing is to be executed. Given a setting that the double-sided printing is to be executed, it is premised that use of back-sided sheets is impermissible in process execution.

Figure 4:
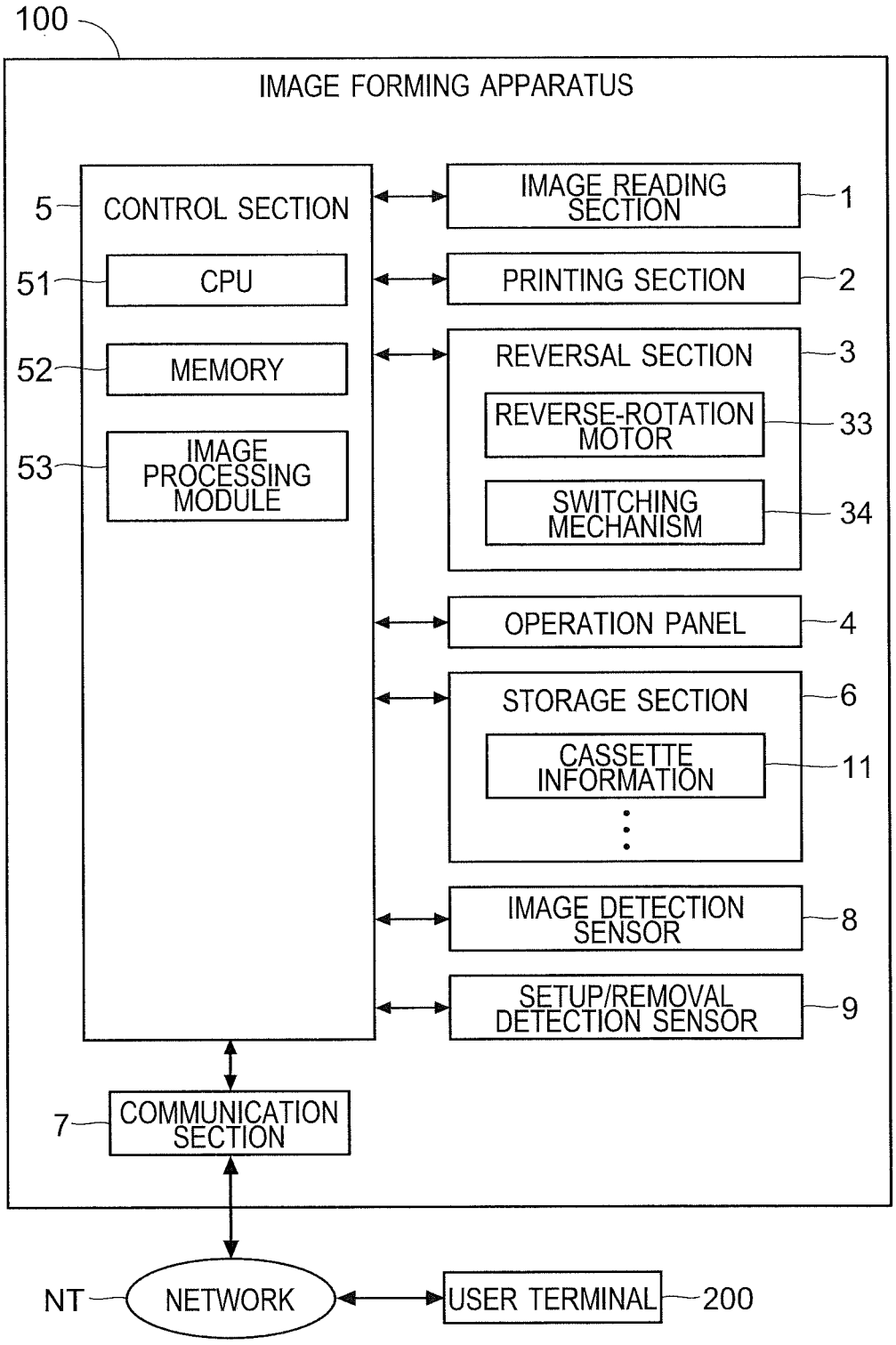
FIG. 4 is a block diagram showing an overall configuration of the image forming apparatus according to one embodiment of the disclosure.

Also as shown in FIG. 4, the image forming apparatus 100 includes a control section 5. The control section 5 includes a CPU 51, memory 52, and an image processing module 53. The CPU 51 operates based on control-dedicated programs and data to execute processing for controlling individual parts and sections of the image forming apparatus 100. The memory 52 stores control-dedicated programs and data for operation of the CPU 51. The image processing module 53 includes exclusive circuits and memory for execution of image processing. With use of the image processing module 53, the control section 5 performs image processing for image data of images to be printed.

The control section 5 is connected to the image reading section 1 and the printing section 2. The control section 5 controls reading operation of the image reading section 1 as well as printing operation (including sheet conveyance operation) of the printing section 2.

The control section 5 is connected also to the reversal section 3. The control section 5 controls reversal process to be executed by the reversal section 3. In terms of control for the reversal process, the control section 5 performs drive control for a reverse-rotation motor 33 as well as drive control for a switching mechanism 34.

The reverse-rotation motor 33 is a motor for rotating the reversal conveyance roller pairs 31. The control section 5 controls the reverse-rotation motor 33 to properly rotate the reversal conveyance roller pairs 31. As the reverse-rotation motor 33, alternatively, such motors may be provided on the image forming apparatus 100 as a motor for rotating reversal conveyance roller pairs 31 on the first conveyance path 30A other than the reversal conveyance roller pair 31S, a motor for rotating the reversal conveyance roller pair 31S, and a motor for rotating the reversal conveyance roller pairs 31 on the second conveyance path 30B, independently of one another.

The switching mechanism 34 is a mechanism for pivoting the switching claw 32. The switching mechanism 34 includes a solenoid as an example. The control section 5 controls the switching mechanism 34 to properly pivot the switching claw 32. That is, the control section 5 performs switching control for the conveyance path of a sheet P being conveyed toward the connecting position CP1.

The control section 5 is connected to the operation panel 4. The control section 5 controls display operation of the operation panel 4, and detects operations performed on the operation panel 4.

For example, under a condition that a document is set on the image reading section 1, upon detecting an operation on the start button of the operation panel 4, the control section 5 decides that an execution instruction for a print job has been accepted. In this case, the control section 5 performs such control as to make the image reading section 1 read the document and to make the printing section 2 execute printing based on image data of the document read by the image reading section 1.

The image forming apparatus 100 also includes a storage section 6. The storage section 6 stores therein information as to the sheet feed cassettes 10. The storage section 6 may be either nonvolatile memory or volatile memory. In addition, the storage section 6 may be assigned to each one of the plural sheet feed cassettes 10, individually.

The storage section 6 is connected to the control section 5. The control section 5 performs writing of information into the storage section 6 as well as reading of information from the storage section 6. For example, cassette information 11 is stored in the storage section 6. The cassette information 11 will be detailed later.

The image forming apparatus 100 further includes a communication section 7. The communication section 7, being an interface for connecting the image forming apparatus 100 to LAN or other network NT, includes a communication circuit, communication memory, a communication connector, and the like.

The communication section 7 is connected to the control section 5. The control section 5 controls communications to be performed by the communication section 7. With use of the communication section 7, the control section 5 performs communications with a user terminal 200 (PC or the like). When the image forming apparatus 100 is used as a printer, job data including print data for use in a print job and a print-job execution instruction is transmitted from the user terminal 200 to the image forming apparatus 100. In the case where the image forming apparatus 100 is used as a printer, print settings (a setting as to whether or not use of back-sided sheets is permitted, etc.) are defined by the user terminal 200, and setting contents of the print settings are included in the job data. When the communication section 7 has received the job data, the control section 5 decides that a print-job execution instruction from the user has been accepted. In this case, the control section 5 generates image data from the print data included in the job data, then instructing the printing section 2 to execute printing based on the generated image data.

In this connection, the image forming apparatus 100 includes an image detection sensor 8. The image detection sensor 8 is a sensor for detecting an image on a sheet P that is passing through the detection position DP (see FIGS. 1 to 3). The image detection sensor 8 is not particularly limited in type. A density sensor may be used as the image detection sensor 8. Otherwise, a CIS (Contact Image Sensor) unit may also be used as the image detection sensor 8.

The image detection sensor 8 is a density sensor, as an example. The image detection sensor 8 includes a light-emitting part and a light-receiving part. The light-emitting part emits light toward a detection-target surface of a sheet P that is passing through the detection position DP, and the light-receiving part receives light reflected by the detection-target surface of the sheet P. Output of the image detection sensor 8 varies depending on light reflectivity or diffusivity at the detection-target surface of the sheet P. That is, the output of the image detection sensor 8 varies depending on presence or absence of any image at the detection-target surface of the sheet P.

Out of the two surfaces of the sheet P passing through the detection position DP, the image detection sensor 8 takes, as the detection-target surface, one surface of the sheet P facing not toward one side (a side toward which the surface to be used for image printing faces when the sheet P passes through the printing position P2 (see FIG. 1)) of the main conveyance path 20A but toward the other side of the main conveyance path 20A opposite to the one side (see FIG. 2). Therefore, in a case where image detection is targeted at a downward-facing surface of a sheet P contained in the sheet feed cassette 10 out of its two surfaces, it is appropriate to detect an output of the image detection sensor 8 resulting when the sheet P contained in the sheet feed cassette 10 has been conveyed up to the detection position DP via the sheet feed position P1 (i.e., when the sheet P has passed through the detection position DP for the first time). In another case where image detection is targeted at an upward-facing surface of a sheet P contained in the sheet feed cassette 10 out of its two surfaces, it is appropriate to detect an output of the image detection sensor 8 resulting when the sheet P conveyed up from the sheet feed cassette 10 via the sheet feed position P1 to the detection position DP, after reversed in its top-and-back orientation by the reversal section 3, has been conveyed up to the detection position DP (i.e., when the sheet P has passed through the detection position DP for the second time).

The image detection sensor 8 is connected to the control section 5. Based on an output of the image detection sensor 8 resulting when the sheet P has passed through the detection position DP, the control section 5 detects presence or absence of an image on the detection-target surface of the sheet P that has passed through the detection position DP. In other words, the control section 5 detects whether or not the detection-target surface is a blank surface with no image thereon.

The image forming apparatus 100 further includes a setup/removal detection sensor 9. The setup/removal detection sensor 9 includes a spring- or interlock-type switch. When a sheet feed cassette 10 is set up to the image forming apparatus 100, the switch of the setup/removal detection sensor 9 is pressed by the sheet feed cassette 10. As a result, there arises a difference in output of the setup/removal detection sensor 9 between setup state and non-setup state of the sheet feed cassettes 10 to the image forming apparatus 100. That is, when the sheet feed cassette 10 has been set up to the image forming apparatus 100, the setup/removal detection sensor 9 outputs a setup signal indicative of the setup state. When the sheet feed cassette 10 has been pulled out from the image forming apparatus 100, the setup/removal detection sensor 9 outputs a non-setup signal indicative of the non-setup state. In addition, in the case where a plurality of sheet feed cassettes 10 are set up to the image forming apparatus 100, one setup/removal detection sensor 9 is assigned to each one of the plural sheet feed cassettes 10.

The setup/removal detection sensor 9 is connected to the control section 5. The control section 5 monitors individual outputs of the plural setup/removal detection sensors 9, respectively. Then, when any setup/removal detection sensor 9 has outputted a non-setup signal, the control section 5 decides that one of the sheet feed cassettes 10 corresponding to the relevant setup/removal detection sensor 9 has been pulled out from the image forming apparatus 100 (i.e., has not been set up to the image forming apparatus 100). After this on, when the relevant setup/removal detection sensor 9 has outputted a setup signal, the control section 5 decides that the sheet feed cassette 10 corresponding to the relevant setup/removal detection sensor 9 has been set up again to the image forming apparatus 100.

<Sheet Decision Process>

(Cassette Information)

The storage section 6 stores, as cassette information 11, information indicating whether sheets P contained in the sheet feed cassettes 10 are back-sided sheets or new sheets. The cassette information 11 is stored in the storage section 6 on a basis of each sheet feed cassette 10. Hereinafter, a sheet feed cassette 10 in which back-sided sheets are contained may be referred to as back-sided sheet-containing cassette, and a sheet feed cassette 10 in which new sheets are contained may be referred to as new sheet-containing cassette.

At a predetermined reset time point, the control section 5 decides whether or not cassette information 11 satisfying an erasing condition has been stored in the storage section 6. As a result, when cassette information 11 satisfying the erasing condition has been stored in the storage section 6, the control section 5 erases the cassette information 11 from the storage section 6.

Upon detecting a setup/removal of a sheet feed cassette 10 based on an output of the setup/removal detection sensor 9 (upon detecting that a sheet feed cassette 10 once pulled out from the image forming apparatus 100 has been set up to the image forming apparatus 100), the control section 5 decides that a reset time point has come up. In this case, on condition that cassette information 11 corresponding to the sheet feed cassette 10 set up to or removed from the image forming apparatus 100 has been stored in the storage section 6, the control section 5 decides that the cassette information 11 satisfies the erasing condition. That is, on condition that cassette information 11 corresponding to a sheet feed cassette 10 set up to or removed from the image forming apparatus 100 has been stored in the storage section 6, only the relevant cassette information 11 is erased. Even when other cassette information 11 has been stored in the storage section 6, the relevant cassette information 11 is not erased.

When main power has been thrown to the image forming apparatus 100, the control section 5 decides that a reset time point has come up. In this state, the control section 5 decides that all of cassette information 11 stored in the storage section 6 satisfies the erasing condition. In this case, all the cassette information 11 stored in the storage section 6 is erased.

Process of making cassette information 11 stored in the storage section 6 is performed by the control section 5. As one step for this process, the control section 5, in execution of a print job, performs for each sheet feed cassette 10 a sheet decision process to decide whether the sheet feed cassette 10 is a back-sided sheet-containing cassette or a new sheet-containing cassette. Then, after execution of the sheet decision process targeted at any one sheet feed cassette 10, the control section 5 instructs the storage section 6 to store therein information indicative of a result of the sheet decision process as cassette information 11 corresponding to the sheet feed cassette 10 targeted for the sheet decision process.

(Process for Cases where No Cassette Information has been Stored)

Hereinbelow described is process that the control section 5 performs for cases where no cassette information 11 has been stored in the storage section 6.

Figure 5:
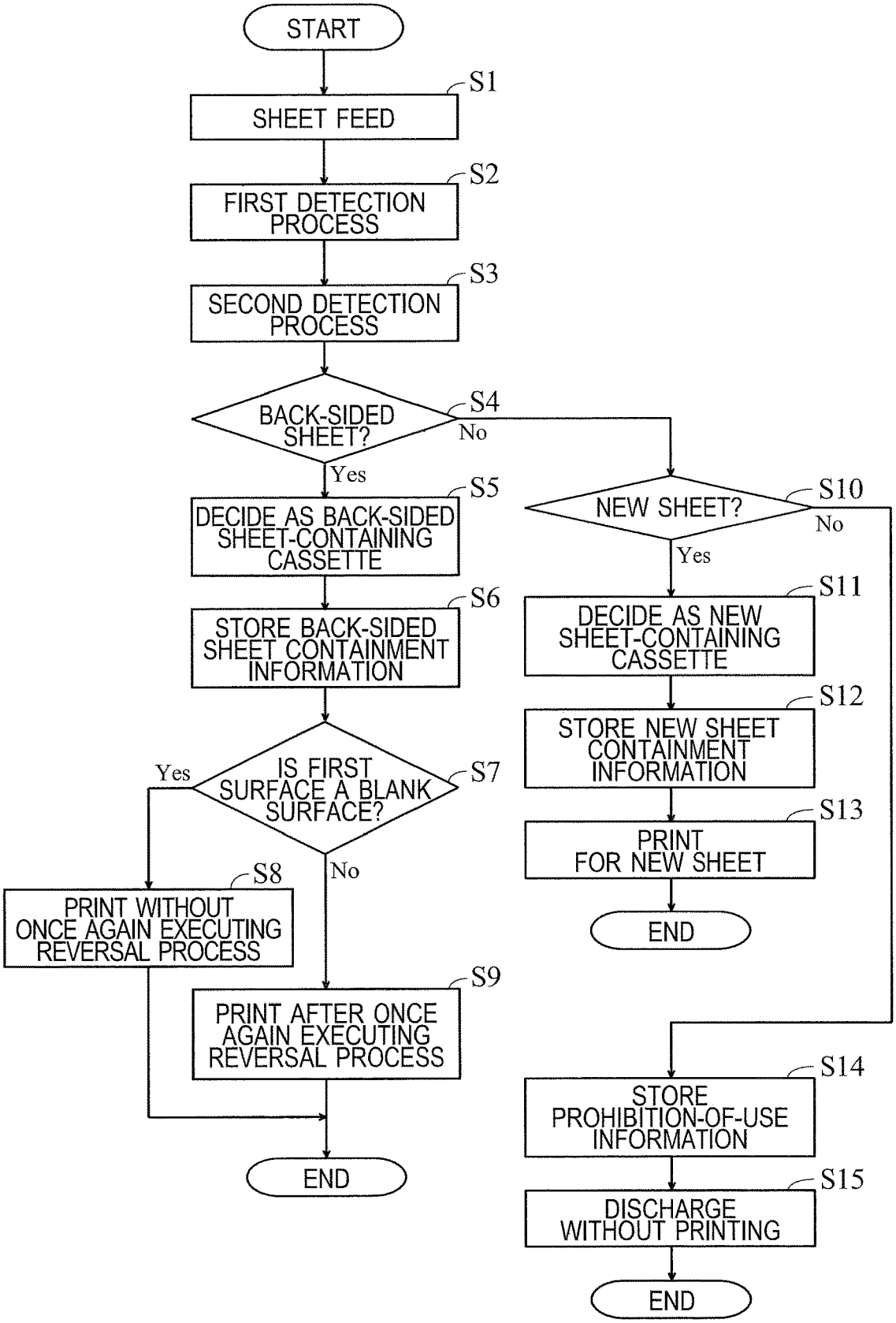
FIG. 5 is a flowchart showing a flow of sheet decision process to be executed by a control section of the image forming apparatus according to one embodiment of the disclosure.

First, a flow of the sheet decision process for a case where use of back-sided sheets is permitted will be described with reference to a flowchart shown in FIG. 5. At a start time of the flowchart shown in FIG. 5, it is assumed that no cassette information 11 has been stored in the storage section 6. The flowchart shown in FIG. 5 starts up when the control section 5 decides that a print-job execution instruction has been accepted.

At step S1, the control section 5 selects one of the plural sheet feed cassettes 10 as a feed source, giving a print command to the printing section 2. The printing section 2, upon receiving the print command, feeds a sheet P from the feed-source sheet feed cassette 10 to the main conveyance path 20A. That is, the printing section 2 conveys the sheet P from the sheet feed position P1 toward the detection position DP.

At step S2, the control section 5 executes a first detection process of detecting whether or not, out of the two surfaces of the sheet P fed to the main conveyance path 20A, one surface (hereinafter, referred to as first surface) that has faced downward while contained in the sheet feed cassette 10 is a blank surface. Based on an output of the image detection sensor 8 resulting when the sheet P fed to the main conveyance path 20A has passed through the detection position DP for the first time, the control section 5 executes, as the first detection process, a process of detecting whether or not the first surface is a blank surface.

At step S3, the control section 5 executes a second detection process of detecting whether or not, out of the two surfaces of the sheet P fed to the main conveyance path 20A, one surface (hereinafter, referred to as second surface) that has faced upward while contained in the sheet feed cassette 10 is a blank surface.

In this connection, prior to the second detection process, the control section 5 instructs the reversal section 3 to execute the reversal process for the sheet P fed to the main conveyance path 20A (the sheet P targeted for the first detection process). After execution of the reversal process by the reversal section 3, the sheet P is conveyed along a route shown in FIG. 3. As a result, the sheet P fed to the main conveyance path 20A, after subjected to the reversal process by the reversal section 3, passes once again through the detection position DP. Then, based on an output of the image detection sensor 8 resulting when the sheet P fed to the main conveyance path 20A has once again passed through the detection position DP, the control section 5 executes, as the second detection process, a process of detecting whether or not the second surface is a blank surface.

At step S4, based on individual results of the first detection process and the second detection process, the control section 5 decides whether or not the sheet P fed to the main conveyance path 20A is a back-sided sheet. As a result, when the control section 5 has decided that the sheet P fed to the main conveyance path 20A is a back-sided sheet, the processing flow moves on to step S5. When the control section 5 has decided that, out of the first surface and the second surface, one is a blank surface and the other is not, the control section 5 decides that the sheet P fed to the main conveyance path 20A is a back-sided sheet.

Upon transition to step S5, the control section 5 decides that the feed-source sheet feed cassette 10 is a back-sided sheet-containing cassette. Then, at step S6, the control section 5 adds, to cassette information 11, back-sided sheet containment information indicative that the feed-source sheet feed cassette 10 is a back-sided sheet-containing cassette (sheets P contained in the feed-source sheet feed cassette 10 are back-sided sheets), and then the control section 5 makes the resulting cassette information 11 stored in the storage section 6 as correspondingly associated with the feed-source sheet feed cassette 10. In the cassette information 11, for example, identification information for the corresponding sheet feed cassette 10 or the like is included.

Thereafter, at step S7, the control section 5 decides whether or not the first surface of the sheet P fed to the main conveyance path 20A is a blank surface. As a result, when the control section 5 has decided that the first surface is a blank surface, the processing flow moves on to step S8; when the control section 5 has decided that the first surface is not a blank surface, the processing flow moves on to step S9. In this connection, the process of step S7 is executed when the control section 5 has decided that the sheet P fed to the main conveyance path 20A is a back-sided sheet. Therefore, that the first surface is a blank surface means that the second surface is not a blank surface, and that the first surface is not a blank surface means that the second surface is a blank surface.

Upon transition to step S8, the control section 5 does not instruct the reversal section 3 as to execution of a second-time reversal process for the sheet P reversed in its top-and-back orientation by the reversal process, and does instruct the printing section 2 to execute printing. In the case where the first surface of the sheet P is a blank surface, the second-time reversal process since the first-time reversal process is not executed, and the sheet P is conveyed toward the printing position P2. As a result, when the sheet P passes through the printing position P2, the blank surface of the sheet P faces toward the one side of the main conveyance path 20A. Thus, an image is printed on the blank surface of the sheet P.

Upon transition to step S9, the control section 5 instructs the reversal section 3 to execute the reversal process once again for the sheet P reversed in its top-and-back orientation by the reversal process, and thereafter the control section 5 instructs the printing section 2 to execute printing. In the case where the second surface of the sheet P is a blank surface, after execution of the second-time reversal process since the first-time reversal process, the sheet P is conveyed toward the printing position P2. As a result, when the sheet P passes through the printing position P2, the blank surface of the sheet P faces toward the one side of the main conveyance path 20A. Thus, an image is printed on the blank surface of the sheet P.

At step S4, when the control section 5 has decided that the sheet P fed to the main conveyance path 20A is not a back-sided sheet, the processing flow moves on to step S10. When detecting that both the first surface and the second surface are blank surfaces, or when detecting that neither the first surface nor the second surface is a blank surface, the control section 5 decides that the sheet P fed to the main conveyance path 20A is not a back-sided sheet.

At step S10, the control section 5 decides whether or not the sheet P fed to the main conveyance path 20A is a new sheet. As a result, when deciding that the sheet P fed to the main conveyance path 20A is a new sheet, the processing flow moves on to step S11. When deciding that both the first surface and the second surface are blank surfaces, the control section 5 decides that the sheet P fed to the main conveyance path 20A is a new sheet.

Upon transition to step S11, the control section 5 decides that the feed-source sheet feed cassette 10 is a new sheet-containing cassette. Then, at step S12, the control section 5 adds, to cassette information 11, new sheet containment information indicative that the feed-source sheet feed cassette 10 is a new sheet-containing cassette (sheets P contained in the feed-source sheet feed cassette 10 are new sheets), and then the control section 5 makes the resulting cassette information 11 stored in the storage section 6 as correspondingly associated with the feed-source sheet feed cassette 10.

Also, at step S13, the control section 5 instructs the printing section 2 to execute printing for the sheet P decided as a new sheet. In this case, the control section 5 prohibits the reversal section 3 from executing the second-time reversal process for the sheet P reversed in its top-and-back orientation by the reversal process.

When the control section 5 has decided at step S10 that the sheet P fed to the main conveyance path 20A is not a new sheet, the processing flow moves on to step S14. That is, when the control section 5 has decided that neither of the two surfaces of the sheet P fed to the main conveyance path 20A is a blank surface, the processing flow moves on to step S14.

Upon transition to step S14, the control section 5 adds prohibition-of-use information to the cassette information 11, then making the resulting cassette information 11 stored in the storage section 6 as correspondingly associated with the feed-source sheet feed cassette 10. Also, at step S15, while prohibiting the printing section 2 from executing printing for the sheet P fed from the feed-source sheet feed cassette 10 to the main conveyance path 20A, the control section 5 makes the sheet P discharged onto the discharge tray ET. In this case, the control section 5 instructs the operation panel 4 to display a notification message for prompting the user to replace sheets P contained in the feed-source sheet feed cassette 10 with other sheets P (back-sided sheets or new sheets).

In addition, when the print job involves a plural number of sheets to be printed, the control section 5 executes the first detection process and the second detection process targeted at the first-coming sheet P fed to the main conveyance path 20A. By those processes, the control section 5 decides whether the feed-source sheet feed cassette 10 is a back-sided sheet-containing cassette or a new sheet-containing cassette, and moreover decides whether or not use of the feed-source sheet feed cassette 10 should be prohibited (i.e., whether or not sheets P contained in the feed-source sheet feed cassette 10 are sheets P having images on both two surfaces).

Then, when deciding that the first surface of the first-coming sheet P fed from the feed-source sheet feed cassette 10 to the main conveyance path 20A is a blank surface and moreover its second surface is not a blank surface, the control section 5, for the second-coming and following sheets P fed to the main conveyance path 20A, instructs the reversal section 3 to once execute the reversal process, and then instructs the printing section 2 to execute printing.

That the first surface of the first-coming sheet P is a blank surface and its second surface is not a blank surface means that the sheet P (back-sided sheet) has been contained in the feed-source sheet feed cassette 10 in such an orientation that its blank surface faces downward. In this case, reversing the top-and-back orientation of the sheet P fed from the feed-source sheet feed cassette 10 to the main conveyance path 20A makes it possible to print an image on the blank surface of the sheet P (back-sided sheet). Accordingly, the reversal process by the reversal section 3 is executed once.

In this connection, that the first surface of a sheet P (back-sided sheet) fed from the feed-source sheet feed cassette 10 to the main conveyance path 20A is a blank surface and its second surface is not a blank surface means that the user has erroneously set the sheet P in its top-and-back orientation in process of setting sheets P (back-sided sheets) contained in the feed-source sheet feed cassette 10. Therefore, when the control section 5, by detecting that the first surface is a blank surface and the second surface is not a blank surface, has decided that the feed-source sheet feed cassette 10 is a back-sided sheet-containing cassette, the control section 5 instructs the operation panel 4 to display a notification message for prompting the user to reverse the top-and-back orientation of the sheets P contained in the feed-source sheet feed cassette 10. As a result, the work of reversing the top-and-back orientation of the sheets P contained in the feed-source sheet feed cassette 10 is executed by the user.

Otherwise, when deciding that the first surface of the first-coming sheet P fed from the feed-source sheet feed cassette 10 to the main conveyance path 20A is not a blank surface and its second surface is a blank surface, the control section 5, for the second-coming and following sheets P, instructs the printing section 2 to execute printing while prohibiting the reversal section 3 from executing the reversal process.

That the first surface of the first-coming sheet P is not a blank surface and its second surface is a blank surface means that sheets P (back-sided sheets) have been contained in the feed-source sheet feed cassette 10 in such an orientation that their blank surfaces face upward. In this case, even without reversing the top-and-back orientation of a sheet P fed from the feed-source sheet feed cassette 10 to the main conveyance path 20A, it is possible to print images on the blank surface of the sheet P (back-sided sheet). Accordingly, the reversal process by the reversal section 3 is not executed.

In addition, some users may desire to preferentially use back-sided sheets. In this case, it is desirable to avoid use of new sheets as much as possible.

Accordingly, under the condition that use of back-sided sheets is permitted, when the control section 5 has decided that the feed-source sheet feed cassette 10 is a new sheet-containing cassette (i.e., the sheet P fed to the main conveyance path 20A is a new sheet), it is allowable to skip, at this time point, execution of printing on the sheet P (new sheet) fed to the main conveyance path 20A.

In this case, without instructing the printing section 2 as to execution of printing on the sheet P (new sheet) fed to the main conveyance path 20A, the control section 5 makes the sheet P discharged onto the discharge tray ET. Thereafter, the control section 5 selects, as a new feed source, another sheet feed cassette 10 out of the plural sheet feed cassettes 10, and executes the sheet decision process targeted at the new feed-source sheet feed cassette 10. When deciding by this sheet decision process that the feed-source sheet feed cassette 10 is a new sheet-containing cassette, the control section 5 further selects an unselected sheet feed cassette 10 as a new feed source, then executing the sheet decision process. That is, the control section 5 repeats the sheet decision process (including a process of making cassette information 11 stored in the storage section 6). Then, when deciding that the feed-source sheet feed cassette 10 is a back-sided sheet-containing cassette (i.e., the sheet P fed to the main conveyance path 20A is a back-sided sheet), the control section 5 instructs the printing section 2 to execute printing on the sheet P fed to the main conveyance path 20A from the sheet feed cassette 10 currently targeted for the sheet decision process (i.e., the sheet feed cassette 10 selected as a feed source).

Assuming that none of the plural sheet feed cassettes 10 is a back-sided sheet-containing cassette, the control section 5 instructs the operation panel 4 to accept a decision as to whether to use new sheets. Then, when the operation panel 4 has accepted from the user a decision of using new sheets, the control section 5 selects a new sheet-containing sheet feed cassette 10 as a feed source, giving a print command to the printing section 2. As a result, printing on new sheets is executed. Otherwise, when the operation panel 4 has accepted from the user a decision of not using new sheets, the operation panel 4 displays a notification message for, for example, prompting the user to change the sheets P contained in the sheet feed cassette 10 to back-sided sheets. As a result, the work of replacing sheets P contained in any one of the plural sheet feed cassettes 10 with back-sided sheets is executed by the user.

In addition, also when the control section 5 has decided that neither of the two surfaces of a sheet P fed to the main conveyance path 20A is a blank surface, the sheet decision process by the control section 5 may be repeatedly executed as in the above case. In this case, when deciding that the feed-source sheet feed cassette 10 is a back-sided sheet-containing cassette (i.e., the sheet P fed to the main conveyance path 20A is a back-sided sheet), or when deciding that the feed-source sheet feed cassette 10 is a new sheet-containing cassette (i.e., the sheet P fed to the main conveyance path 20A is a new sheet), the control section 5 instructs the printing section 2 to execute printing on the sheet P fed to the main conveyance path 20A.

Figure 6:
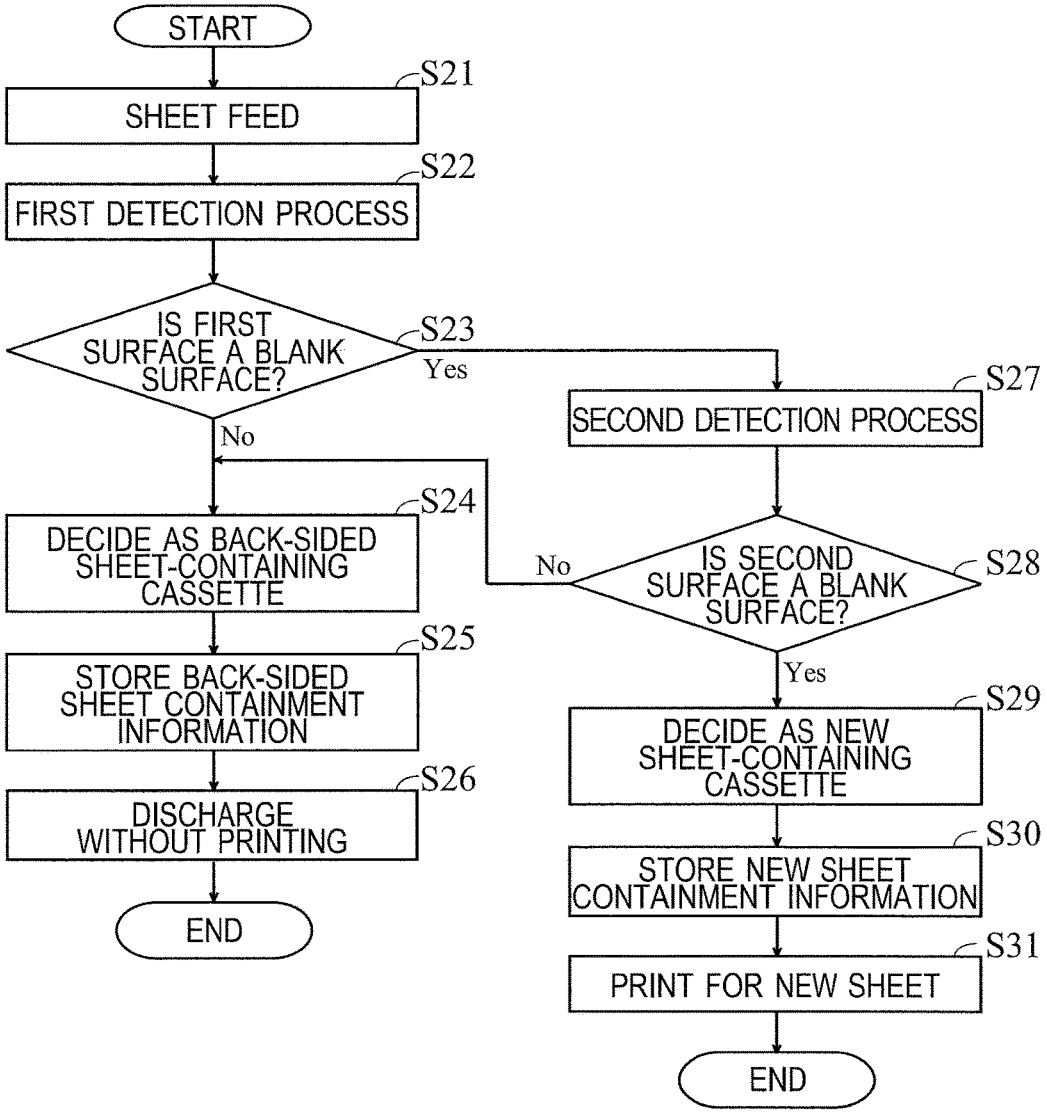
FIG. 6 is a flowchart showing a flow of sheet decision process to be executed by the control section of the image forming apparatus according to one embodiment of the disclosure.

Next, a flow of the sheet decision process for another case where use of back-sided sheets is not permitted will be described with reference to a flowchart shown in FIG. 6. At a start time of the flowchart shown in FIG. 6, it is assumed that no cassette information 11 has been stored in the storage section 6. The flowchart shown in FIG. 6 starts up when the control section 5 decides that a print-job execution instruction has been accepted.

At step S21, the control section 5 selects one of the plural sheet feed cassettes 10 as a feed source, giving a print command to the printing section 2. The printing section 2, upon receiving the print command, feeds a sheet P from the feed-source sheet feed cassette 10 to the main conveyance path 20A. That is, the printing section 2 conveys the sheet P from the sheet feed position P1 toward the detection position DP.

At step S22, the control section 5 executes a first detection process of detecting an image on one surface (first surface) of the sheet P. The first detection process to be executed by the control section 5 in this case is the same as the first detection process in step S2 of FIG. 5.

Then, at step S23, the control section 5 decides whether or not the first surface of the sheet P is a blank surface. As a result, in a case where the control section 5 has decided that the first surface is not a blank surface, the processing flow moves on to step S24.

Upon transition to step S24, the control section 5 decides that the feed-source sheet feed cassette 10 is a back-sided sheet-containing cassette. That is, the control section 5 decides that the sheet P fed to the main conveyance path 20A is a back-sided sheet. Then, at step S25, the control section 5 adds, to cassette information 11, back-sided sheet containment information indicative that the feed-source sheet feed cassette 10 is a back-sided sheet-containing cassette (sheets P contained in the feed-source sheet feed cassette 10 are back-sided sheets), and then the control section 5 makes the resulting cassette information 11 stored in the storage section 6 as correspondingly associated with the feed-source sheet feed cassette 10. In this case, the control section 5 makes need-for-confirmation information added to the cassette information 11 corresponding to the feed-source sheet feed cassette 10. The reason for adding the need-for-confirmation information to the cassette information 11 will be described later.

Thereafter, at step S26, while prohibiting the printing section 2 from executing printing for the sheet P fed from the feed-source sheet feed cassette 10 to the main conveyance path 20A, the control section 5 makes the sheet P discharged onto the discharge tray ET. The reason for doing so is that the sheet P fed to the main conveyance path 20A is not a new surface. That is, a sheet P having an image on at least one of its two surfaces is discharged onto the discharge tray ET.

In another case where the control section 5 has decided at step S23 that the first surface is a blank surface, the processing flow moves on to step S27. Upon transition to step S27, the control section 5 executes a second detection process of detecting the other surface (second surface) of the sheet P. The second detection process to be executed by the control section 5 in this case is the same as the second detection process in step S3 of FIG. 5.

Then, at step S28, the control section 5 decides whether or not the second surface of the sheet P is a blank surface. As a result, when the control section 5 decides that the second surface is not a blank surface, the processing flow moves on to step S24. After this on, the individual processes of steps S24 to S25 are executed successively by the control section 5. However, in the case where the first surface is a blank surface and the second surface is not a blank surface (where both the first detection process and the second detection process have been executed), the control section 5, during execution of the process of step S25, prevents need-for-confirmation information from being included in the cassette information 11 corresponding to the feed-source sheet feed cassette 10.

That the first surface is a blank surface and the second surface is not a blank surface means that sheets P contained in the feed-source sheet feed cassette 10 by the user have proved to be back-sided sheets. However, the sheets P contained in the feed-source sheet feed cassette 10 have been set in erroneous top-and-back orientation. Accordingly, the control section 5 instructs the operation panel 4 to display a notification message for prompting the user to reverse the top-and-back orientation of the sheets P contained in the feed-source sheet feed cassette 10.

At step S28, when the control section 5 has decided that the second surface is a blank surface, the processing flow moves on to step S29. That is, when both the first surface and the second surface are blank surfaces, the processing flow moves on to step S29. That the processing flow has moved to step S29 means that the sheet P fed to the main conveyance path 20A is a new sheet (i.e., new sheets have been contained in the feed-source sheet feed cassette 10).

Upon transition to step S29, the control section 5 decides that the feed-source sheet feed cassette 10 is a new sheet-containing cassette. Then, at step S30, the control section 5 adds, to cassette information 11, new sheet containment information indicative that the feed-source sheet feed cassette 10 is a new sheet-containing cassette (sheets P contained in the feed-source sheet feed cassette 10 are new sheets), and then the control section 5 makes the resulting cassette information 11 stored in the storage section 6 as correspondingly associated with the feed-source sheet feed cassette 10. Further, at step S31, the control section 5 instructs the printing section 2 to execute printing on the sheet P (new sheet) fed to the main conveyance path 20A.

In addition, when deciding that the feed-source sheet feed cassette 10 is a back-sided sheet-containing cassette (i.e., the sheet P fed to the main conveyance path 20A is a back-sided sheet), the control section 5 selects another sheet feed cassette 10 as a new feed source, and executes a sheet decision process (including a process of making cassette information 11 stored in the storage section 6) targeted at the new feed-source sheet feed cassette 10. Until deciding that the feed-source sheet feed cassette 10 is a new sheet-containing cassette, the control section 5 repeatedly executes the sheet decision process with the feed source changed over. Then, when deciding that the feed-source sheet feed cassette 10 is a new sheet-containing cassette (i.e., the sheet P fed to the main conveyance path 20A is a new sheet), the control section 5 instructs the printing section 2 to execute printing on the sheet P fed to the main conveyance path 20A from the sheet feed cassette 10 currently targeted for the sheet decision process (i.e., the sheet feed cassette 10 selected as the feed source).

Assuming that none of the plural sheet feed cassettes 10 is a new sheet-containing cassette, the control section 5 instructs the operation panel 4 to display a notification message for prompting the user to change the sheets P contained in the sheet feed cassettes 10 to new sheets. As a result, the work of replacing sheets P contained in any one of the plural sheet feed cassettes 10 with new sheets is executed by the user.

(Process for Cases where Cassette Information has been Stored)

Hereinbelow, it is assumed that cassette information 11 corresponding to at least one sheet feed cassette 10 out of the plural sheet feed cassettes 10 has been stored in the storage section 6.

Upon accepting a print-job execution instruction, the control section 5 decides whether or not use of back-sided sheets is permitted. In a case where the use of back-sided sheets is permitted, the control section 5 selects, as a feed source, a sheet feed cassette 10 whose corresponding cassette information 11 includes back-sided sheet containment information, and then the control section 5 gives a print command to the printing section 2. The printing section 2 feeds a sheet P from the feed-source sheet feed cassette 10 to the main conveyance path 20A, and executes printing on the fed sheet P. The sheet P fed to the main conveyance path 20A in this case is a back-sided sheet.

In this connection, the control section 5 has recognized based on the cassette information 11 that the feed-source sheet feed cassette 10 is a back-sided sheet-containing cassette. Accordingly, the control section 5 suppresses execution of the sheet decision process (first detection process, and second detection process involving reversal process by the reversal section 3).

However, this is inapplicable to cases where need-for-confirmation information is included in the cassette information 11 corresponding to the feed-source sheet feed cassette 10. That the need-for-confirmation information is included in cassette information 11 means that only the first detection process has been executed for the sheet P precedently fed from the feed-source sheet feed cassette 10 to the main conveyance path 20A (i.e., it has been detected by the first detection process that the first surface is not a blank surface). That is, there is a possibility that, out of the two surfaces of the sheets P contained in the feed-source sheet feed cassette 10, neither the downward-facing surface (first surface) nor the upward-facing surface (second surface) is a blank surface.

Therefore, given that the need-for-confirmation information is included in the cassette information 11 corresponding to the feed-source sheet feed cassette 10, the control section 5 executes the second detection process targeted for the sheet P fed to the main conveyance path 20A to detect whether or not the second surface of the sheet P is a blank surface. As a result, when the second surface is a blank surface, the control section 5 instructs the printing section 2 to execute printing on the sheet P fed to the main conveyance path 20A.

Meanwhile, when the second surface is not a blank surface, the control section 5, while prohibiting the printing section 2 from executing printing on the sheet P fed to the main conveyance path 20A, makes the sheet P discharged onto the discharge tray ET. Also, the control section 5 updates the cassette information 11 corresponding to the feed-source sheet feed cassette 10 (updates cassette information 11 including the back-sided sheet containment information to cassette information 11 including prohibition-of-use information). Thereafter, the control section 5 changes the feed source to another sheet feed cassette 10 whose corresponding cassette information 11 includes back-sided sheet containment information.

When no cassette information 11 including back-sided sheet containment information has been stored in the storage section 6, the control section 5 decides whether or not there is a sheet feed cassette 10 whose corresponding cassette information 11 has not been stored, i.e., an unprocessed sheet feed cassette 10 that has not been subjected to the sheet decision process. In a case where there is an unprocessed sheet feed cassette 10, the control section 5 executes the process along the flowchart of FIG. 5 with the unprocessed sheet feed cassette 10 targeted therefor.

Meanwhile, in another case where there is no unprocessed sheet feed cassette 10, i.e., where only cassette information 11 including new sheet containment information has been stored in the storage section 6 (where all of the plural sheet feed cassettes 10 are new sheet-containing cassettes), the control section 5 instructs the operation panel 4 to execute an acceptance as to whether or not new sheets are used. When the operation panel 4 has accepted use of new sheets from the user, the control section 5 selects a new sheet-contained sheet feed cassette 10 as a feed source, and gives a print command to the printing section 2. As a result of this, printing for the new sheet is executed. When the operation panel 4 has accepted non-use of new sheets from the user, the operation panel 4 displays, for example, a notification message for prompting the user to change sheets P contained in the sheet feed cassette 10 to back-sided sheets. As a result, the work of replacing sheets P contained in any one of the plural sheet feed cassettes 10 with back-sided sheets is executed by the user.

In a case where use of back-sided sheets is not permitted as a result of the decision as to whether or not use of back-sided sheets is permitted, the control section 5 selects, as a feed source, a sheet feed cassette 10 whose corresponding cassette information 11 includes new sheet containment information, and the control section 5 gives a print command to the printing section 2. The printing section 2 feeds a sheet P from the feed-source sheet feed cassette 10 to the main conveyance path 20A, and executes printing on the fed sheet P. The sheet P fed to the main conveyance path 20A in this case is a new sheet.

In another case where no cassette information 11 including new sheet containment information has been stored in the storage section 6, the control section 5 decides whether or not there is a sheet feed cassette 10 whose corresponding cassette information 11 has not been stored, i.e., an unprocessed sheet feed cassette 10 that has not been subjected to the sheet decision process. When there is an unprocessed sheet feed cassette 10, the control section 5 executes the process along the flowchart of FIG. 6 with the unprocessed sheet feed cassette 10 targeted therefor.

Meanwhile, when there is no unprocessed sheet feed cassette 10, i.e., when only cassette information 11 including back-sided sheet containment information has been stored in the storage section 6 (when all of the plural sheet feed cassettes 10 are back-sided sheet-containing cassettes), the control section 5 instructs the operation panel 4 to display a notification message for prompting the user to change the sheets P contained in the sheet feed cassettes 10 to new sheets. As a result, the work of replacing sheets P contained in any one of the plural sheet feed cassettes 10 with new sheets is executed by the user.

In addition, the control section 5 does not select, as a feed source, any sheet feed cassette 10 whose corresponding cassette information 11 includes prohibition-of-use information. That is, the control section 5 prohibits use of any sheet feed cassette 10 that has contained sheets P for which it has been detected that neither the first surface nor the second surface is a blank surface.

As described hereinabove, the image forming apparatus 100 according to this embodiment includes: a sheet feed cassette 10 for containing sheets P of paper therein; a printing section 2 which includes a main conveyance path 20A running through a sheet feed position P1, a detection position DP, and a printing position P2 in this order, and which feeds a sheet P out of the sheets P contained in the sheet feed cassette 10 from the sheet feed position P1 to the main conveyance path 20A, then conveys the sheet P along the main conveyance path 20A, and prints an image on one surface out of two surfaces of the sheet P passing through the printing position P2, the one surface facing toward one side of the main conveyance path 20A; a reversal section 3 for reversing top-and-back orientation of a sheet P by pulling in the sheet P at a halfway position between the detection position DP and the printing position P2 of the main conveyance path 20A, switching back the pulled-in sheet P, and executing a reversal process of returning the switched-back sheet P from the halfway position between the sheet feed position P2 and the detection position DP of the main conveyance path 20A to the main conveyance path 20A; an image detection sensor 8 for detecting an image on a sheet P passing through the detection position DP; and a control section 5 for, in execution of a print job involving printing by the printing section 2, executing a first detection process of, based on an output of the image detection sensor 8 resulting when a sheet P fed to the main conveyance path 20A has passed through the detection position DP for the first time, detecting whether or not a first surface of the sheet P is a blank surface, and moreover executing a second detection process of, based on an output of the image detection sensor 8 resulting when the sheet P fed to the main conveyance path 20A has once again passed through the detection position DP after the reversal process by the reversal section 3, detecting whether or not a second surface of the sheet P opposite to the first surface is a blank surface, whereby the control section 5, based on individual results of the first detection process and the second detection process, executes a sheet decision process of deciding whether the sheet feed cassette 10 is a back-sided sheet-containing cassette in which back-sided sheets with images present only on one surface are contained or a new sheet-containing cassette in which new sheets with images present on neither of their two surfaces are contained.

According to the configuration of this embodiment, the inclusion of the reversal section 3 makes it possible to detect presence or absence of any image on each of the two surfaces of a sheet P. That is, it becomes possible to execute the first detection process and the second detection process. By virtue of this, it becomes possible to decide whether or not the sheet feed cassette 10 is a back-sided sheet-containing cassette (whether or not sheets P contained in the sheet feed cassette 10 are back-sided sheets). Moreover, in the case where the sheet feed cassette 10 is a back-sided sheet-containing cassette, it also becomes possible to decide the blank-surface orientation of sheets P (back-sided sheets) contained in the sheet feed cassette 10.

Also according to this embodiment, under a condition that use of the back-sided sheets is permitted, when the control section 5, by detecting that the first surface is not a blank surface and the second surface is a blank surface, has decided that the feed-source sheet feed cassette 10 is a back-sided sheet-containing cassette, the control section 5 instructs the reversal section 3 to once again execute the reversal process for the sheet P reversed in its top-and-back orientation by the reversal process, and thereafter further instructs the printing section to execute printing. Thus, it never occurs that an image is printed on a surface of the back-sided sheet opposite to its blank surface.

Also according to this embodiment, under a condition that use of the back-sided sheets is permitted, when the control section 5, by detecting that the first surface is a blank surface and the second surface is not a blank surface, has decided that the feed-source sheet feed cassette 10 is a back-sided sheet-containing cassette, the control section 5 instructs the printing section 2 to execute printing while prohibiting the reversal section 3 from once again executing the reversal process for the sheet P reversed in its top-and-back orientation by the reversal process. Thus, it never occurs that an image is printed on a surface of the back-sided sheet opposite to its blank surface.

Also according to this embodiment, under a condition that the print job involves a plural number of sheets to be printed, the control section 5 executes the first detection process and the second detection process targeted at a first-coming sheet P fed to the main conveyance path 20A.

Then, when the control section 5, by detecting that the first surface is not a blank surface and the second surface is a blank surface, has decided that the feed-source sheet feed cassette 10 is a back-sided sheet-containing cassette, the control section 5, for second-coming and following sheets P, instructs the printing section 2 to execute printing while prohibiting the reversal section 3 from executing the reversal process. Thus, also for the second-coming and following sheets P, it never occurs that an image is printed on a surface of the back-sided sheet opposite to its blank surface. Further, since the reversal process by the reversal section 3 is not executed for the second-coming and following sheets P, it becomes possible to suppress any prolongation of time until completion of the print job.

Meanwhile, when the control section 5, by detecting that the first surface is a blank surface and the second surface is not a blank surface, has decided that the feed-source sheet feed cassette 10 is a back-sided sheet-containing cassette, the control section 5, for second-coming and following sheets P, instructs the reversal section 3 to once execute the reversal process, and thereafter instructs the printing section 2 to execute printing. Thus, also for the second-coming and following sheets P, it never occurs that an image is printed on a surface of the back-sided sheet opposite to its blank surface. Further, since the work of reversing top-and-back orientation of the sheets P (back-sided sheets) contained in the feed-source sheet feed cassette 10 may be performed after completion of the print job, there is no need for halting the print job under execution.

Also according to this embodiment, as described above, the control section 5 makes cassette information 11 indicative of a result of the sheet decision process stored in the storage section 6, and in execution of the print job with the cassette information 11 stored in the storage section 6, the control section 5, based on the cassette information 11, decides whether the feed-source sheet feed cassette 10 is a back-sided sheet-containing cassette or a new sheet-containing cassette. Thus, it becomes unnecessary to execute the sheet decision process (first detection process and the second detection process), so that any prolongation of time required until completion of the print job can be suppressed.

Also according to this embodiment, when the control section 5 has detected a setup/removal of the sheet feed cassette 10 based on an output of the setup/removal detection sensor, or when main power has been thrown to the image forming apparatus 100, the control section 5 decides that the reset time point has come up, and erases the cassette information 11 from the storage section 6. In a case where the sheet feed cassette 10 has been set up or removed, it is highly likely that replacement work for sheets P contained in the sheet feed cassette 10 (e.g., replacement work from new sheets to back-sided sheets or replacement work from back-sided sheets to new sheets) has been executed by the user. Further, the replacement work for sheets P contained in the sheet feed cassette 10 may be executed during a period in which main power of the image forming apparatus 100 has been shut off. Therefore, on such occasions as a setup of the sheet feed cassette 10 or throwing of the main power to the image forming apparatus 100, it is preferable that predecessor cassette information 11 be erased from the storage section 6 and cassette information 11 on which a result of the subsequently executed sheet decision process has been reflected be newly stored in the storage section 6.

Also according to this embodiment, the control section 5 executes the sheet decision process for each of the sheet feed cassettes 10, where under a condition that use of the back-sided sheets is not permitted, when deciding that the sheet feed cassette 10 that has contained a sheet P fed to the main conveyance path 20A is not a new sheet-containing cassette, the control section 5 executes the sheet decision process targeted at another sheet feed cassette 10 that has not been subjected to the sheet decision process, whereby when deciding that the sheet feed cassette 10 is a new sheet-containing cassette, the control section 5 instructs the printing section 2 to execute printing on a sheet P fed from the sheet feed cassette that is currently targeted for the sheet decision process. Thus, there arises no such disadvantage as an image is printed on a back-sided sheet in spite of non-permission of use of the back-sided sheets. Further, it is unnecessary for the user to perform operation (setting) of changing the feed-source sheet feed cassette 10 or the like, hence user convenience.

Also according to this embodiment, when deciding that none of the sheet feed cassettes 10 is a new sheet-containing cassette, the control section 5 instructs the operation panel 4 to execute notification for prompting a change of sheets P contained in the sheet feed cassettes 10 to new sheets. Thus, a notification that replacement work for sheets P contained in the sheet feed cassettes 10 is needed can be made recognizable for the user.

Also according to this embodiment, when deciding that the first surface is a blank surface and the second surface is not a blank surface, the control section 5 instructs the operation panel 4 to execute notification for prompting reversal of top-and-back orientation of sheets P (back-sided sheets) contained in the feed-source sheet feed cassette 10. Thus, even without executing work of checking the sheets P contained in the sheet feed cassette 10, it can be known that the top-and-back orientation of the sheets P is erroneous (the work of reversing the top-and-back orientation is needed), hence user convenience.

Also according to this embodiment, the control section 5 prohibits use of the sheet feed cassette 10 that has contained sheets P for which it has been detected that neither the first surface nor the second surface is a blank surface. Thus, it never occurs that sheets P having images on both two surfaces are used in a print job.

The embodiment disclosed herein should be construed as not being limitative but being an exemplification at all points. The scope of the disclosure is defined not by the above description of the embodiment but by the appended claims, including all changes and modifications equivalent in sense and range to the claims.

For example, the above-described embodiment has been described on a case where the sheet decision process is executed in execution of the first print job since an arrival of the reset time point. However, the sheet decision process may be executed in execution of every print job. Further, the sheet decision process may also be executed each time one sheet P is fed to the main conveyance path 20A.

It is also allowable that cassette information 11 stored in the storage section 6 is transmitted from the image forming apparatus 100 to the user terminal 200 and contents of the cassette information 11 (whether sheets P contained in the sheet feed cassette 10 are back-sided sheets or new sheets) are displayed on the user terminal 200. In this case, the user is enabled to recognize a sheet feed cassette 10 having desired sheets P contained therein based on the contents of the cassette information 11. By virtue of this, it becomes possible to assign, as a feed source, a sheet feed cassette 10 having back-sided sheets contained therein when use of back-sided sheets is desired, and to assign, as a feed source, a sheet feed cassette 10 having new sheets contained therein when use of new sheets is desired.

For example, when the user has assigned a feed-source sheet feed cassette 10 with the user terminal 200, assigned cassette information is included in job data to be transmitted from the user terminal 200 to the image forming apparatus 100. The assigned cassette information is information indicative of the sheet feed cassette 10 assigned by the user (here referred to as assigned sheet feed cassette 10).

When the assigned cassette information is included in job data, the control section 5 selects the assigned sheet feed cassette 10 as a feed source. As a result, sheets P are fed from the assigned sheet feed cassette 10 to the main conveyance path 20A.

In this connection, that the user has assigned a sheet feed cassette 10 highly likely means that sheets P of the user's desire out of new sheets and back-sided sheets are contained in the assigned sheet feed cassette 10. Further, when the sheets P of the user's desire are back-sided sheets, it is highly likely that sheets P of the user's desire (back-sided sheets) are contained in the assigned sheet feed cassette 10 in their correct top-and-back orientation.

Accordingly, based on an output of the image detection sensor 8 resulting when a sheet P fed from the assigned sheet feed cassette 10 to the main conveyance path 20A has passed through the detection position DP for the first time, the control section 5 detects whether or not the first surface of the sheet P is a blank surface, where when a detection result is in agreement with contents of cassette information 11 corresponding to the assigned sheet feed cassette 10, the control section 5 continues the print job without detecting whether or not the second surface is a blank surface. That is, for example, under the condition that use of back-sided sheets is not permitted by the user (when the user desires to use new sheets), when the first surface is a blank surface, the control section 5 decides that the second surface also is a blank surface (decides that new sheets are contained in the assigned sheet feed cassette 10). As a result of this, processing time for the print job can be shortened.

Meanwhile, when the detection result is in disagreement with the contents of the cassette information 11 corresponding to the assigned sheet feed cassette 10, the control section 5 halts the print job. Then, with use of the communication section 7, the control section 5 notifies the user terminal 200 that the detection result is in disagreement with the contents of the cassette information 11 corresponding to the assigned sheet feed cassette 10. In this case, a decision as to whether the halted print job is to be continued or quitted may be accepted from the user.

Also, with the configuration of this embodiment, when a sheet P having an image only on one surface or a sheet P having images on both surfaces is fed to the main conveyance path 20A, the sheet P is discharged without being printed thereon depending on a result of the sheet decision process (the sheet P is here referred to as printing-unexecuted sheet P). When discharge of the printing-unexecuted sheet P is destined for the discharge tray ET just as printed matter yielded by the print job is destined, there arises a difficulty in discriminating whether the sheet P discharged to the discharge tray ET is a piece of printed matter of the print job or a printing-unexecuted sheet P.

Therefore, in the configuration of this embodiment, a discharge part for printing-unexecuted sheets may be provided not on one end side of the first conveyance path 30A (on which the connecting position CP1 is located) but on the other side opposite to the one end side of the first conveyance path 30A, so that printing-unexecuted sheets P may be discharged to the discharge part for printing-unexecuted sheets. As a result, since printed matter of print jobs and printing-unexecuted sheets P are separated from each other, it becomes simpler to discard or reuse printing-unexecuted sheets P. With such arrangement, printing-unexecuted sheets P can be discharged to the discharge part for printing-unexecuted sheets by controlling the reversal conveyance roller pair 31S in such fashion that a sheet P present on the first conveyance path 30A continues to be conveyed so as to go away from the connecting position CP1.

What is claimed is:

1. An image forming apparatus comprising:

a sheet feed cassette for containing sheets of paper therein;

a printing section which includes a main conveyance path running through a sheet feed position, a detection position, and a printing position in this order, and which feeds a sheet out of the sheets contained in the sheet feed cassette from the sheet feed position to the main conveyance path, then conveys the sheet along the main conveyance path, and prints an image on one surface out of two surfaces of the sheet passing through the printing position, the one surface facing toward one side of the main conveyance path;

a reversal section for reversing top-and-back orientation of a sheet by pulling in the sheet at a halfway position between the detection position and the printing position of the main conveyance path, switching back the pulled-in sheet, and executing a reversal process of returning the switched-back sheet from the halfway position between the sheet feed position and the detection position of the main conveyance path to the main conveyance path;

an image detection sensor for detecting an image on a sheet passing through the detection position; and a control section for, in execution of a print job involving printing by the printing section, executing a first detection process of, based on an output of the image detection sensor resulting when a sheet fed to the main conveyance path has passed through the detection position for a first time, detecting whether or not a first surface of the sheet is a blank surface, and moreover executing a second detection process of, based on an output of the image detection sensor resulting when the sheet fed to the main conveyance path has once again passed through the detection position after the reversal process by the reversal section, detecting whether or not a second surface of the sheet opposite to the first surface is a blank surface, whereby the control section, based on individual results of the first detection process and the second detection process, executes a sheet decision process of deciding whether the sheet feed cassette is a back-sided sheet-containing cassette in which back-sided sheets with images present only on one surface are contained or a new sheet-containing cassette in which new sheets with images present on neither of their two surfaces are contained.

2. The image forming apparatus according to claim 1, wherein the image detection sensor takes, as a detection-target surface, one surface out of two surfaces of a sheet passing through the detection position, the one surface facing toward the other side of the main conveyance path opposite to the one side of the main conveyance path, and under a condition that use of the back-sided sheets is permitted, when the control section, by detecting that the first surface is not a blank surface and the second surface is a blank surface, has decided that the sheet feed cassette is the back-sided sheet-containing cassette, the control section instructs the reversal section to once again execute the reversal process for the sheet reversed in its top-and-back orientation by the reversal process, and thereafter further instructs the printing section to execute printing.

3. The image forming apparatus according to claim 2, wherein under a condition that the print job involves a plural number of sheets to be printed, the control section executes the first detection process and the second detection process targeted at a first-coming sheet fed to the main conveyance path, whereby when the control section, by detecting that the first surface is not a blank surface and the second surface is a blank surface, has decided that the sheet feed cassette is the back-sided sheet-containing cassette, the control section, for second-coming and following sheets, instructs the printing section to execute printing while prohibiting the reversal section from executing the reversal process.

4. The image forming apparatus according to claim 1, wherein the image detection sensor takes, as a detection-target surface, one surface out of two surfaces of a sheet passing through the detection position, the one surface facing toward the other side of the main conveyance path opposite to the one side of the main conveyance path, and under a condition that use of the back-sided sheets is permitted, when the control section, by detecting that the first surface is a blank surface and the second surface is not a blank surface, has decided that the sheet feed cassette is the back-sided sheet-containing cassette, the control section instructs the printing section to execute printing while prohibiting the reversal section from executing the reversal process once again for the sheet reversed in its top-and-back orientation by the reversal process.

5. The image forming apparatus according to claim 4, wherein under a condition that the print job involves a plural number of sheets to be printed, the control section executes the first detection process and the second detection process targeted at a first-coming sheet fed to the main conveyance path, whereby when the control section, by detecting that the first surface is a blank surface and the second surface is not a blank surface, has decided that the sheet feed cassette is the back-sided sheet-containing cassette, the control section, for second-coming and following sheets, instructs the reversal section to once execute the reversal process, and thereafter instructs the printing section to execute printing.

6. The image forming apparatus according to claim 1, further comprising a storage section, wherein the control section makes cassette information indicative of a result of the sheet decision process stored in the storage section, and in execution of the print job with the cassette information stored in the storage section, the control section, based on the cassette information, decides whether the sheet feed cassette is the back-sided sheet-containing cassette or the new sheet-containing cassette.

7. The image forming apparatus according to claim 6, wherein when a predetermined reset time point has come up, the control section erases the cassette information.

8. The image forming apparatus according to claim 7, further comprising a setup/removal detection sensor for detecting a setup/removal of the sheet feed cassette, wherein when the control section has detected a setup/removal of the sheet feed cassette based on an output of the setup/removal detection sensor, or when main power has been thrown to the image forming apparatus, the control section decides that the reset time point has come up.

9. The image forming apparatus according to claim 1, wherein the sheet feed cassette is provided in plurality, and the control section executes the sheet decision process for each of the sheet feed cassettes, where under a condition that use of the back-sided sheets is not permitted, when deciding that the sheet feed cassette that has contained a sheet fed to the main conveyance path is not the new sheet-containing cassette, the control section executes the sheet decision process targeted at another said sheet feed cassette that has not been subjected to the sheet decision process, whereby when deciding that the sheet feed cassette is the new sheet-containing cassette, the control section instructs the printing section to execute printing on a sheet fed from the sheet feed cassette that is currently targeted for the sheet decision process.

10. The image forming apparatus according to claim 9, further comprising a notification part, wherein when deciding that none of the sheet feed cassettes is the new sheet-containing cassette, the control section instructs the notification part to execute notification for prompting a change of sheets contained in the sheet feed cassettes to the new sheets.

11. The image forming apparatus according to claim 1, further comprising a notification part, wherein when deciding that the first surface is a blank surface and the second surface is not a blank surface, the control section instructs the notification part to execute notification for prompting reversal of top-and-back orientation of sheets contained in the sheet feed cassette.

12. The image forming apparatus according to claim 1, wherein the control section prohibits use of the sheet feed cassette that has contained sheets for which it has been detected that neither the first surface nor the second surface is a blank surface.

* * * * *